US005348591A

United States Patent [19]

Masumoto et al.

[11] Patent Number: 5,348,591

[45] Date of Patent: Sep. 20, 1994

[54] HIGH-STRENGTH AMORPHOUS MAGNESIUM ALLOY

[75] Inventors: Tsuyoshi Masumoto, 8-22, Kamisugi 3-chome, Aoba-ku, Sendai-shi, Miyagi-ken, Japan; Akihisa Inoue, Miyagi; Akira Kato, Miyagi; Toshisuke Shibata, Miyagi; Nobuyuki Nishiyama, Tokyo, all of Japan

[73] Assignees: Tsuyoshi Masumoto, Miyagi, Japan; Toyota Jidosha Kabushiki Kaisha, Aichi, Japan; Yoshida Kogyo K.K., Chiyoda, Japan; Teikoku Piston Ring Co., Ltd., Chuo, Japan

[21] Appl. No.: 937,602

[22] Filed: Sep. 2, 1992

[30] Foreign Application Priority Data

Sep. 6, 1991 [JP] Japan ..... 3-254143

[51] Int. Cl.[5] ..... C22C 95/00

[52] U.S. Cl. ..... 148/403; 148/420; 420/403; 420/405

[58] Field of Search ..... 148/403, 420; 420/403, 420/405, 406, 411, 414

[56] References Cited

U.S. PATENT DOCUMENTS

| | | | |
|---|---|---|---|
| 5,078,807 | 1/1992 | Chang et al. | 420/405 |
| 5,118,368 | 6/1992 | Masumoto et al. | 148/420 |
| 5,129,960 | 7/1992 | Chang et al. | 420/405 |

FOREIGN PATENT DOCUMENTS

| | | |
|---|---|---|
| 0219628 | 4/1987 | European Pat. Off. . |
| 0361136 | 4/1990 | European Pat. Off. . |
| 0407964 | 1/1991 | European Pat. Off. . |
| 3-87339 | 4/1991 | Japan . |

*Primary Examiner*—George Wyszomierski
*Attorney, Agent, or Firm*—Armstrong, Westerman, Hattori, McLeland & Naughton

[57] ABSTRACT

An amorphous magnesium alloy has a composition of $Mg_aM_bX_c$ (M is Zn and/or Ga, X is La, Ce, Mm (misch metal), Y, Nd, Pr, Sm and Gd), a is from 65 to 96.5 atomic %, b is from 3 to 30 atomic %, and c is from 0.2 to 8 atomic %). The magnesium alloy has a high specific strength and does not embrittle at room temperature.

3 Claims, 4 Drawing Sheets

HIGH-STRENGTH AMORPHOUS MAGNESIUM ALLOY

BACKGROUND OF THE INVENTION

1. Field of Invention

The present invention relates to an amorphous magnesium alloy having improved specific strength and ductility, and to a method for producing the same.

2. Description of Related Arts

Magnesium alloys have tensile strength of approximately 24 kg/mm$^2$ and specific gravity of 1.8, as is stipulated in JIS H5203, MC2. Magnesium alloys have therefore a high specific strength and are promising materials to reduce weight of automotive vehicles, which weight reduction is required for conserving fuel consumption.

Japanese Unexamined Patent Publication No. 3-10141 proposes an amorphous magnesium alloy having a composition of Mg-rare earth element-transition element. The proposed amorphous magnesium alloy has a high strength; however, since a large amount of the rare-earth element is added to vitrify the Mg alloy, enhancement of the specific strength is less than expected. The proposed Mg alloy would therefore not be as competitive as other high specific strength materials.

It is also known that the ternary Mg-Al-Ag magnesium alloy can be vitrified. The Mg-Al-Ag amorphous alloy has a low crystallization temperature and has the disadvantage of embrittlement when exposed at room temperature in ambient atmosphere for approximately 24 hours.

The Mg-rare earth element-transition metal alloy has a higher specific weight than the Mg-Al-Ag alloy and hence does not have a satisfactorily high specific strength. In addition, since several compositions of the Mg-rare earth o element-transition metal alloy embrittle when exposed as described above, the properties of this alloy are unstable. Under the circumstances described above, development of the practical application of Mg alloys has lagged behind Al alloys.

SUMMARY OF THE INVENTION

It is therefore an object of the present invention to provide an amorphous magnesium alloy, which has a sufficiently high Mg content and high strength so as to attain high specific strength, which has a sufficiently high crystallization temperature so as to attain improved heat-resistance, and which does not embrittle when exposed at room temperature.

It is another object of the present invention to provide a method for producing the amorphous magnesium alloy mentioned above.

The present inventors discovered that specific elements added to a Mg-rich composition can provide an amorphous Mg alloy which has a high strength.

A high-strength amorphous magnesium alloy provided by the present invention has a composition of $Mg_aM_bX_c$ (M is at least one element selected from the group consisting of Zn and Ga, X is at least one element selected from the group consisting of La, Ce, Mm (misch metal), Y, Nd, Pt, Sm and Gd, a is from 65 to 96.5 atomic %, b is from 3 to 30 atomic %, and c is from 0.2 to 8 atomic %), and has at least 50% of amorphous phase.

Another high-strength amorphous magnesium alloy provided by the present invention has a composition of $Mg_dM_eX_fT_g$ (M is at least one element selected from the group consisting of Zn and Ga, X is at least one element selected from a group consisting of La, Ce, Mm (misch metal), Y, Nd, Pr, Sm and Gd, T is at least one element selected from the group consisting of Ag, Zr, Ti and Hf, d is from 65 to 96.5 atomic %, e is from 2 to 30 atomic %, f is from 0.2 to 8 atomic %, and g is from 0.5 to 10 atomic %), and has at least 50% of amorphous phase.

A method for producing a high-strength amorphous magnesium alloy according to the present invention is characterized by cooling, at a cooling speed of from $10^2$ to $10^5$° C./s, a magnesium-alloy melt having a composition of $Mg_aM_bX_c$ (M is at least one element selected from the group consisting of Zn and Ga, X is at least one element selected from a group consisting of La, Ce, Mm (misch metal), Y, Nd, Pr, Sm and Gd, a is from 65 to 96.5 atomic %, b is from 3 to 30 atomic %, and c is from 0.2 to 8 atomic %).

Another method for producing a high-strength amorphous magnesium alloy according to the present invention is characterized by cooling, at a cooling speed of from $10^2$ to $10^5$° C./s, an alloy melt having a composition of $Mg_dM_eX_fT_g$ (M is at least one element selected from the group consisting of Zn and Ga, X is at least one element selected from a group consisting of La, Ce, Mm (misch metal), Y, Nd, Pr, Sm and Gd, T is at least one element selected from the group consisting of Ag, Zr, Ti and Hf, d is from 65 to 96.5 atomic %, e is from 2 to 30 atomic %, f is from 0.2 to 8 atomic %, and g is from 0.5 to 10 atomic %).

Mg is a major element for providing light weight. M (Zn and/or Ga), and X (La, Ce, Mm, Y, Nd, Pr, Sm and/or Gd) are vitrifying elements. T (Ag, Zr, Ti and/or Hf) is/are element(s) for attaining improved ductility. A part of T is a solute of the crystalline Mg. Another part of T becomes a component of the amorphous phase and enhances the crystallization temperature.

In the light of attaining high strength Ce, La and Mn are preferred, because these elements can enhance the tensile strength as high as or higher than the other X element at an identical atomic %.

When M is added in an amount greater than 30 atomic %, an Mg-M compound precipitates in a great amount and also the specific weight increases. On the other hand, when M is added in an amount smaller than 3 atomic %, vitrification becomes difficult. When X is added in an amount smaller than 0.2 atomic %, vitrification becomes difficult. On the other hand, when X is added in an amount greater than 8 atomic %, not only does embrittlement occur but also specific weight increases. When T is added in an amount smaller than 0.5 atomic %, neither heat-resistance nor strength is enhanced effectively. On the other hand, when T is added in an amount greater than 10 atomic %, vitrification becomes difficult.

The amorphous phase must be 50% or more, because embrittlement occurs at a smaller amorphous phase.

The above mentioned alloys can be vitrified at least 50% by cooling the alloy melt at a cooling rate of from $10^2$ to $10^5$° C./s which is the normal cooling rate. A 100% amorphous structure can be obtained by increasing the cooling speed. The phase other than the amorphous phase is a crystalline $\alpha$-Mg (M, X and T are solutes) having hcp structure. This crystalline Mg phase is from 1 to 100 nm in size and disperses in the amorphous phase as particles and strengthens the Mg alloy. When the magnesium particles are uniformly dispersed in the amorphous matrix, the strength is exceedingly high.

The melt-quenched amorphous alloy can then be heat-treated at a temperature lower than the crystallization temperature (Tx) which is in the range of from 120 to 262° C. Then, the magnesium particles are separated and precipitate in the amorphous matrix. Strength is enhanced usually by approximately 100 MPa, but elongation decreases as compared with the melt-quenched state.

The present invention is hereinafter described with reference to the drawings.

EXAMPLES

EXAMPLE 1

Figure 1:
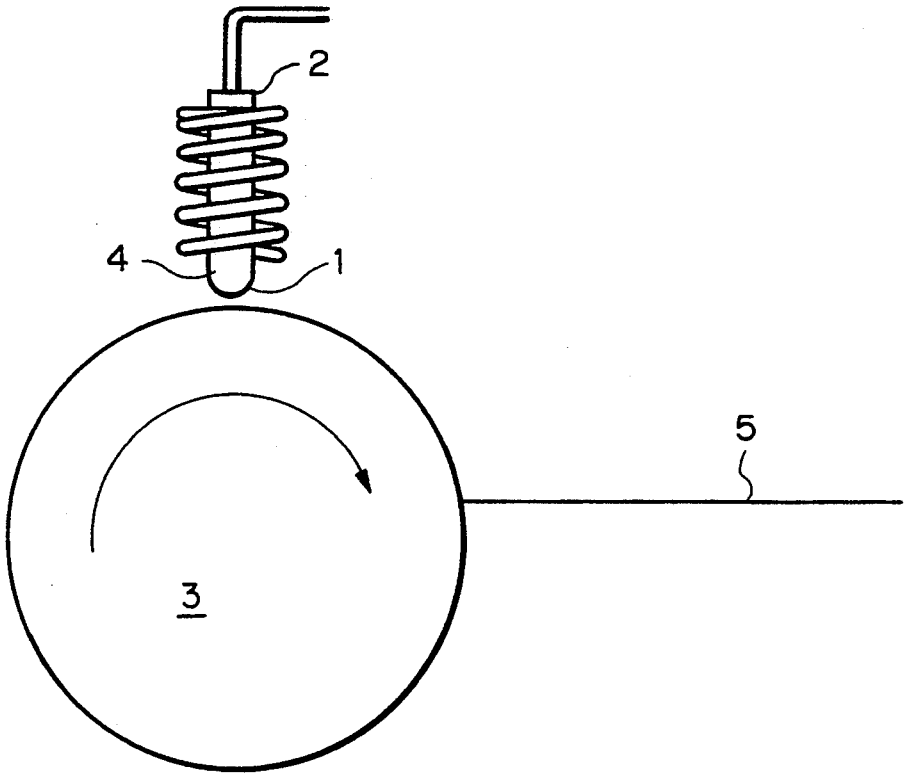
FIG. 1 illustrates a single-roll apparatus.

A magnesium alloy, whose composition is given in Table 1, was prepared as mother alloy by a high-frequency melting furnace. The mother alloy was melt-quenched and solidified by the single-roll method which is well known as a method for producing amorphous alloys. A ribbon was thus produced. A quartz tube 2, with an orifice 0.1 mm in diameter at the front end, was filled with the mother alloy in the form of an ingot. The mother alloy was then heated and melted. The quartz tube 2 was then positioned directly above the roll 2 made of copper. The resultant molten alloy 4 in the quartz tube 4 was ejected through the orifice 2 under argon gas pressure and was brought into contact with the surface of roll 3. An alloy ribbon 5 was thus produced by melt quenching and solidification at a cooling speed of $10^3$° C./s.

Figure 2:
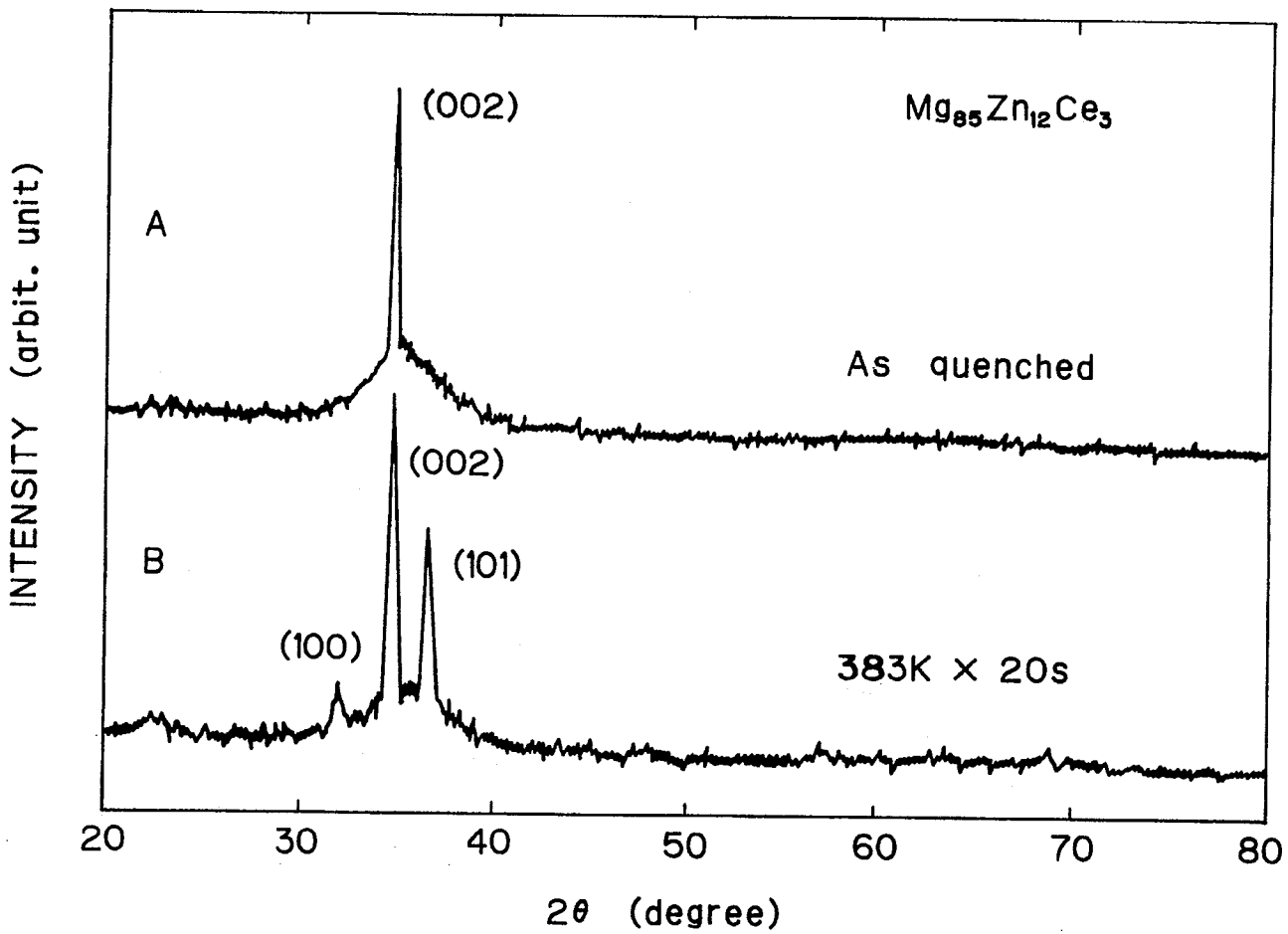
FIG. 2 shows X-ray diffraction patterns.

The alloy ribbon 5 had a composition of $Mg_{85}Zn_{12}Ce_3$ and was 20 μm thick and 1 mm wide. The alloy ribbon was subjected to X-ray diffraction by a diffractometer. The result is shown in FIG. 2 as "A". In the diffraction pattern, a halo pattern of amorphous alloy and a peak of Mg are recognized. The proportion of crystalline Mg was 12%.

Figure 3A:
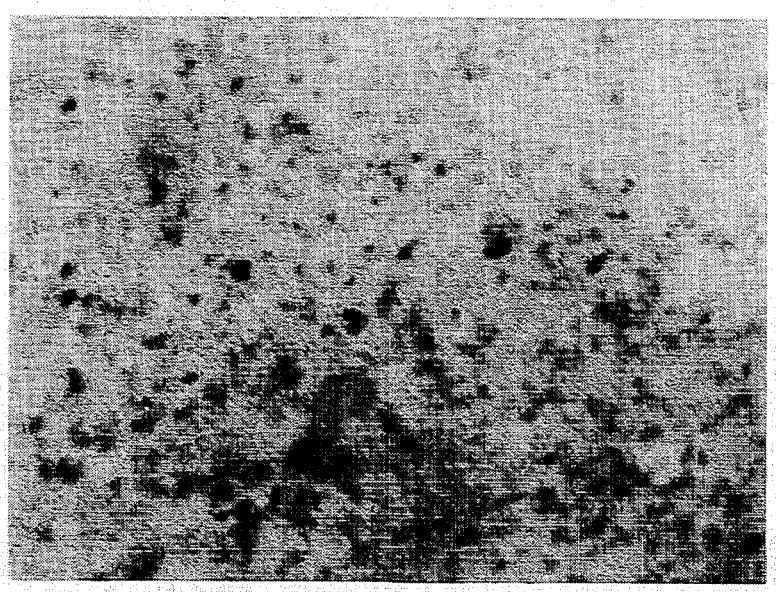
FIGS. 3A and C show the dark-field and bright-field of electronic microscope images of a ribbon material, respectively.
Figure 3B:
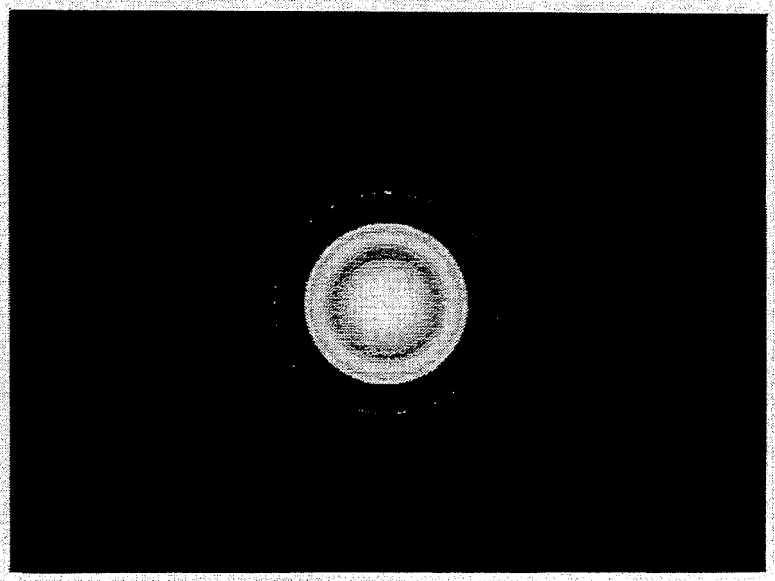
FIG. 3B shows an electron-diffraction pattern of the ribbon material.
Figure 3C:
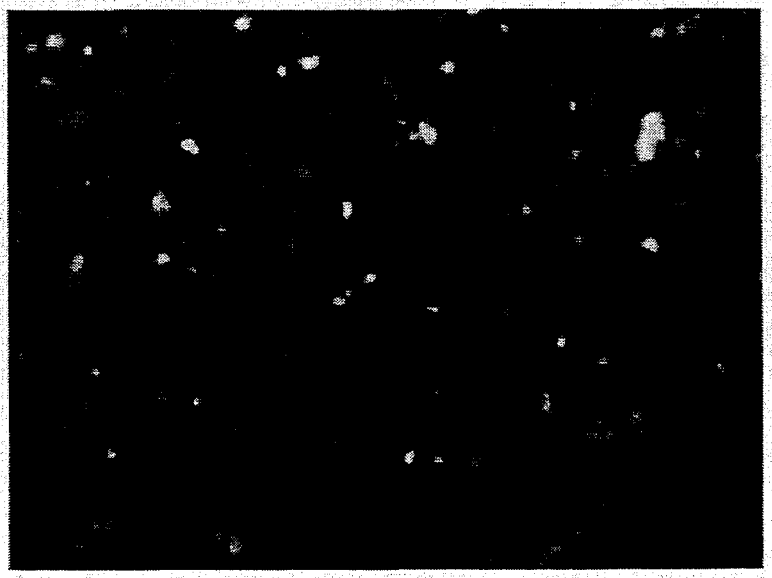

The alloy ribbon was heat-treated at a temperature lower by 1° C. than the crystallization temperature (Tx) for 20 seconds. X-ray diffraction pattern of the heat-treated ribbon is shown in FIG. 2 as "B". Peaks of the hcp Mg are clear as compared with the diffraction pattern of the non-heat-treated alloy. Structure of the heat-treated alloy was observed by an electronic microscope. It was revealed that particles 10 nm or finer were dispersed in the amorphous matrix in a proportion of 20% (FIG. 3). The proportion of amorphous phase in 80%.

TABLE 1

| | $Mg_{85}Zn_{12}Ce_3$ | |
|---|---|---|
| | Melt-Quenched Material | Heat-treated Material |
| Structure | Amorphous + Crystalline | Amorphous + Crystalline |
| Tensile Strength | 670 MPa | 980 MPa |
| Elongation | 7% | 3% |
| Hardness (Hv) | 175 | 210 |

The crystalline phase of the molt-quenched material is an hcp Mg.

EXAMPLE 2

Magnesium alloys, whose compositions are given in Table 2, were prepared as mother alloys by a high-frequency melting furnace. The mother alloys were melt-quenched and solidified by the single roll to produce the ribbons. The results of X-ray diffraction of the ribbons are given in Table 2.

The ribbons were allowed to stand at room temperature for 24 hours and then subjected to bend test and tensile test. The results of a 180° tight bend test and tensile test are given in Table 2.

TABLE 2

| | Composition | Structure | 180° tight bending | Tensile Strength (MPa) | Tx (°C.) |
|---|---|---|---|---|---|
| Inventive | | | | | |
| 1 | $Mg_{80}Zn_{15}Mm_5$ | Amorphous + Crystalline | Possible | 680 | 170 |
| 2 | $Mg_{80}Zn_{15}Y_5$ | Amorphous + Crystalline | Possible | 590 | 167 |
| 3 | $Mg_{80}Zn_{15}Ce_5$ | Amorphous + Crystalline | Possible | 630 | 173 |
| 4 | $Mg_{80}Zn_{15}La_5$ | Amorphous + Crystalline | Possible | 650 | 167 |
| Comparative | | | | | |
| 5 | $Mg_{97}Zn_2La_1$ | Crystalline | Brittle | — | 77 |
| 6 | $Mg_{64}Zn_{35}Ce_1$ | Amorphous | Possible | 500 | 87 |
| Inventive | | | | | |
| 7 | $Mg_{84}Zn_{10}La_5Ag_1$ | Amorphous + Crystalline | Possible | 680 | 158 |
| 8 | $Mg_{73}Zn_{20}La_5Ti_1Ag_1$ | Amorphous + Crystalline | Possible | 690 | 162 |
| 9 | $Mg_{74}Zn_{20}Ce_5Ag_1$ | Amorphous + Crystalline | Possible | 650 | 168 |
| 10 | $Mg_{74}Zn_{20}Y_5Ag_1$ | Amorphous + Crystalline | Possible | 630 | 172 |
| 11 | $Mg_{79}Zn_{20}Y_{0.5}Hf_{0.5}$ | Amorphous + Crystalline | Possible | 645 | 158 |
| 12 | $Mg_{79}Ga_{15}Nd_5Ag_1$ | Amorphous + Crystalline | Possible | 620 | 207 |
| 13 | $Mg_{79}Ga_{15}Mm_5Ag_1$ | Amorphous + Crystalline | Possible | 595 | 207 |
| 14 | $Mg_{79}Zn_{15}Gd_5Ag_1$ | Amorphous + Crystalline | Possible | 580 | 226 |
| Inventive | | | | | |
| 15 | $Mg_{79}Zn_{15}Ce_5Ag_1$ | Amorphous + Crystalline | Possible | 590 | 177 |
| Inventive | | | | | |
| 16 | $Mg_{79}Ga_{15}Ce_5Ag_1$ | Amorphous + Crystalline | Possible | 620 | 208 |
| Comparative | | | | | |
| 17 | $Mg_{58}Ga_{35}Ce_5Ti_2$ | Amorphous | Possible | 490 | 217 |
| 18 | $Mg_{58}Zn_{35}La_5Ti_2$ | Amorphous + | Possible | 500 | 157 |
| 19 | $Mg_{92}Ga_1La_5Ti_2$ | Crystalline | Brittle | — | — |

TABLE 2-continued

| | Composition | Structure | 180° tight bending | Tensile Strength (MPa) | Tx (°C.) |
|---|---|---|---|---|---|
| 20 | $Mg_{89}Zn_1La_5Ag_5$ | Crystalline | Brittle | — | — |

The above ribbons were heat-treated for 0.1 hour at a temperature 10° C. lower than the crystallization temperature (Tx). The bend and tensile tests were then carried out. The results are given in Table 3.

TABLE 3

| | Composition | Structure | 180° tight bending | Tensile Strength (MPa) |
|---|---|---|---|---|
| Inventive | | | | |
| 1 | $Mg_{80}Zn_{15}Mm_5$ | Amorphous + Crystalline | Possible | 780 |
| 2 | $Mg_{80}Zn_{15}Y_5$ | Amorphous + Crystalline | Possible | 800 |
| 3 | $Mg_{80}Zn_{15}Ce_5$ | Amorphous + Crystalline | Possible | 780 |
| 4 | $Mg_{80}Zn_{15}La_5$ | Amorphous + Crystalline | Possible | 790 |
| Comparative | | | | |
| 5 | $Mg_{97}Zn_2La_1$ | Crystalline | Brittle | — |
| 6 | $Mg_{64}Zn_{35}Ce_1$ | Amorphous | Possible | 650 |
| Inventive | | | | |
| 7 | $Mg_{84}Zn_{10}La_5Ag_1$ | Amorphous + Crystalline | Possible | 780 |
| 8 | $Mg_{73}Zn_{20}La_5Ti_1Ag_1$ | Amorphous + Crystalline | Possible | 820 |
| 9 | $Mg_{74}Zn_{20}Ce_5Ag_1$ | Amorphous + Crystalline | Possible | 780 |
| 10 | $Mg_{74}Zn_{20}Y_5Ag_1$ | Amorphous + Crystalline | Possible | 790 |
| 11 | $Mg_{79}Zn_{20}Y_{0.5}Hf_1$ | Amorphous + Crystalline | Possible | 780 |
| 12 | $Mg_{79}Ga_{15}Nd_5Ag_1$ | Amorphous + Crystalline | Possible | 780 |
| 13 | $Mg_{79}Ga_{15}Mm_5Ag_1$ | Amorphous + Crystalline | Possible | 690 |
| 14 | $Mg_{79}Zn_{15}Gd_5Ag_1$ | Amorphous + Crystalline | Possible | 720 |
| 15 | $Mg_{79}Zn_{15}Ce_5Ag_1$ | Amorphous | Possible | 680 |
| 16 | $Mg_{79}Ga_{15}Ce_5Ag_1$ | Amorphous + Crystalline | Possible | 780 |
| Comparative | | | | |
| 17 | $Mg_{58}Ga_{35}Ce_5Ti_2$ | Amorphous | Possible | 530 |
| 18 | $Mg_{58}Zn_{35}La_5Ti_2$ | Amorphous + | Possible | 490 |
| 19 | $Mg_{58}Ga_1La_5Ti_2$ | Crystalline | Brittle | — |
| 20 | $Mg_{88}Zn_1La_5Ag_5$ | Crystalline | Brittle | — |

As is clear from the above experimental results, the Mg alloy according to the present invention has a high strength and can be vitrified even at an Mg rich composition. The Mg alloy according to the present invention is tough and does not embrittle so that it can be bent at a angle of 180°.

The specific gravity of the Mg alloy according to the present invention is approximately 2.4. The specific strength in terms of tensile strength (kg/mm$^2$)/specific gravity is approximately 14 kg/mm$^2$ and hence very high.

We claim:

1. A high-strength amorphous magnesium alloy, comprising $Mg_dM_eX_FT_g$ wherein M is at least one element selected from the group consisting of Zn and Ga, X is at least one element selected from a group consisting of La, Ce, Y, Nd, Pr, Sm and Gd, T is at least one element selected from a group consisting of Ag, Zr, Ti and Hf, d is from 65 to 96.5 atomic %, e is from 2 to 30 atomic %, f is from 0.2 to 8 atomic %, and g is from 0.5 to 10 atomic %, and has at least 50% amorphous phase.

2. A high-strength amorphous magnesium alloy according to claim 1, whose structure consists of said amorphous phase and hcp magnesium particles which are dispersed in a matrix consisting of said amorphous phase.

3. A high-strength amorphous magnesium alloy according to claim 2, wherein said hcp particles are form 1 to 100 nm in size.

* * * * *